United States Patent [19]

Myers et al.

[11] Patent Number: 4,993,918

[45] Date of Patent: Feb. 19, 1991

[54] REPLACEABLE FAIRING FOR A TURBINE EXHAUST CASE

[75] Inventors: Richard S. Myers, Palm Beach Gardens; Peter T. Vercellone, Lake Worth, both of Fla.

[73] Assignee: United Technologies Corporation, Hartford, Conn.

[21] Appl. No.: 354,060

[22] Filed: May 19, 1989

[51] Int. Cl.[5] ..... F03B 3/00; F04D 17/16

[52] U.S. Cl. ..... 415/191; 415/209.3; 415/209.2

[58] Field of Search ..... 416/204 R, 204 A, 214 R, 416/220 R, 194, 195; 415/912, 915, 9, 12, 182.1, 183, 189, 190, 191, 200, 208.1, 209.1, 209.2, 209.3, 209.4, 210.1; 403/253, 254, 353; 29/156.8 H, 156.8 R

[56] References Cited

U.S. PATENT DOCUMENTS

| | | | |
|---|---|---|---|
| 2,884,078 | 4/1959 | Stamm et al. | 29/156.8 H |
| 2,980,396 | 4/1961 | Mosesian | 415/189 |
| 3,079,128 | 2/1963 | Burge | 415/191 |
| 3,156,282 | 11/1964 | Bedford, Jr. | 403/254 |
| 3,166,295 | 1/1965 | Szewalski et al. | 415/209.4 |
| 3,856,434 | 12/1974 | Hoffmann | 416/214 R |
| 4,108,562 | 8/1978 | Collard et al. | 403/254 |
| 4,365,933 | 12/1982 | Langer et al. | 415/210.1 |
| 4,643,636 | 2/1987 | Libertini et al . | 415/200 |

FOREIGN PATENT DOCUMENTS

| | | | |
|---|---|---|---|
| 2115883 | 9/1983 | United Kingdom | 416/209 A |

*Primary Examiner*—Edward K. Look
*Assistant Examiner*—Hoang Nguyen
*Attorney, Agent, or Firm*—Norman Friedland

[57] ABSTRACT

A free floating fairing comprising an outer ring fairing, an inner ring fairing and a three piece replaceable strut fairing define an aerodynamic contour and heat shield for the turbine exhaust case of a gas turbine engine. The material fo the fairing can be selected to optimize heat transfer characteristics to enhance the structural integrity of the supporting structure while assuring the lubrication in the lubricating passages in the struts does not coke and the preload on the support rods is not lost during engine operation. The inner ring fairing serves to hold in place the nose piece of the three piece strut fairing for ease of replacement.

13 Claims, 3 Drawing Sheets

REPLACEABLE FAIRING FOR A TURBINE EXHAUST CASE

TECHNICAL FIELD

This invention relates to gas turbine engines and particularly to the engine's exhaust case frame disposed in the gas path.

BACKGROUND ART

As is generally well-known, gas turbine engines are continually undergoing changes with goals of improving performance, decreasing size and weight for a given thrust rating, while reducing cost and enhancing durability, producibility and repairability. To improve performance, it is typical to increase the operation temperature of the engine since increased turbine temperatures is tantamount to improved engine performance. Of course, these increased temperatures necessitate other changes in the engine to handle the increased thermals so as to maintain structural integrity of the engine's components.

In heretofore known engines, the turbine exhaust case and its struts that are disposed in the gas path are typically unshielded from the environment and hence, its durability would be predicated on the material selected. Some attempts have been made to encapsulate the struts with an aerodynamic fairing that would also serve as a heat shield for the strut by welding the fairing in situ. Obviously, since the welding is performed manually, one would expect to find variations from assembly to assembly and quality would be highly dependant on the skill of the welder. And, of course, the weldment, if not done properly, is susceptible to malfunction. As would be appreciated by one skilled in the art, the welded fairing presents a difficult fabrication, requiring much fit up at assembly and results in undesirable weld distortion with potential stress risers at the weld joints. Also, repair of locally cracked, eroded or otherwise damaged areas require "patch" welding or complete refabrication. This type of construction and consequent repair is therefore difficult and costly. Furthermore, the strut fairing is essentially a "one piece" welded construction and is life limited by inherent thermal stresses due to both radial and axial temperature gradients.

Further, with the use of a welded fairing the leading edge or "nose" which first sees the gas path flow stream is subjected to the major abuse and hence susceptible to a limited life. The hot gases in the gas path impinge on the nose, the nose is subjected to a high temperature profile since the hotter gas temperatures are toward the middle of the hot gas flow path and additionally it incurs potential hot streaks owing to circumferential unevenness of the temperature profile in the gas flow path.

Since the struts are designed to allow passage of the support rods and service lines that feed lubricating oil to the bearings, it is abundantly important that the heat shield protect those components of the engines. To this end, the lubrication lines must be sufficiently cool to prevent oil from coking. The support rods, likewise, must be sufficiently cool to prevent loss of preload which is set at assembly caused by temperature differences between the inner bearing compartment, the rods and the outer duct support/mount ring that may occur during engine operations.

We have found that we can obviate the problem noted above by providing a replaceable multi-piece fairing to the exhaust case. It is contemplated that the strut fairing will be fabricated in three parts wherein the nose is made from a separate single piece that is capable of being removed from the remaining portion of the assembly. Since the nose is first to see the hottest portion of the gas path and is susceptible to foreign object damage, it can be made of materials that resists these hazards which may be different from the material used in the other pieces.

Likewise, the material of the fairing can be different from the material of the structural parts of the turbine exhaust case. In this manner, the fairing can be made from materials that exhibit good thermal characteristics at elevated temperatures while the structural frame can be made from materials that exhibit higher strength with lower temperature capabilities.

Since the fairing is made from a number of pieces, these pieces can be readily removed so as to enhance the repairability of the assembly. Nor would the entire casing have to be removed to repair the fairing assembly.

It is further contemplated that the fairing not only serves to keep the structure at lower temperatures, it is radially free floating relative to the structural frame so as to minimize, if not eliminate, thermal stresses that would otherwise occur.

DISCLOSURE OF INVENTION

An object of this invention is to provide an improved structural frame exposed to the gas path of a gas turbine power plant. A feature of this invention is to provide improved fairing for a turbine exhaust case characterized as being made from a number of removable parts so as to improve the durability of the parts while enhancing the producibility and repairability of the fairing assembly.

A still further feature of this invention is to fabricate the multi-piece, replaceable exhaust case fairing so that it is essentially radially free-floating relative to the structural components of the turbine exhaust case.

A still further feature of this invention is to fabricate the fairing encapsulating the structural strut into three component parts including a single removable nose piece that could be fabricated from material that is different from the other two halves.

A still further feature is to utilize the inner diameter annular fairing to secure the nose piece.

Another feature of this invention is to provide an improved fairing as described that is characterized as relatively easy to assemble and disassembly, capable of being fabricated from materials that are high temperature resistant and free from welds.

The foregoing and other objects, features and advantages of the present invention will become more apparent in light of the following detailed description of the preferred embodiments thereof and the drawings.

BEST MODE FOR CARRYING OUT THE INVENTION

Figure 1:
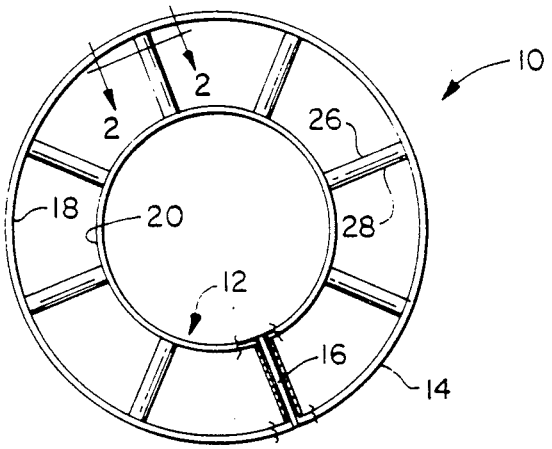
FIG. 1 schematically shows a turbine exhaust case of the type intended to support the shaft bearings of a gas turbine engine.

Reference is now made to FIGS. 1–5 inclusive which show the turbine exhaust case that serves to support the rear bearing compartment of a gas turbine engine (not shown) and holds the rotor relative to the stationary engine hardware. For more detail of this type of construction, reference should be made to U.S. Pat. No. 2,938,336, granted to C. J. Peterson on May 31, 1960 and to the F-100 family of gas turbine engines manufactured by Pratt & Whitney Aircraft Division of United Technologies Corporation, the assignee of this patent application. As noted from FIG. 1, the turbine exhaust case 10 includes an inner ring element 12 and an outer concentric ring element 14 interconnected by circumferentially spaced radial struts 16. The struts are encapsulated in the fairing as will be explained hereinbelow. As mentioned above, it would be typical to fabricate this component without any fairing. The struts 16 not only serve as structural components, they also serve to provide an internal passageway for the lubrication lines and the supporting rods. Obviously, utilizing the struts for this purpose avoids placing these components in the engine's gas path which is bounded by the outer fairing 18, adjacent outer ring member 14, the inner fairing 20 adjacent inner ring member 12, noting that the struts are disposed in the gas path.

Figure 4:
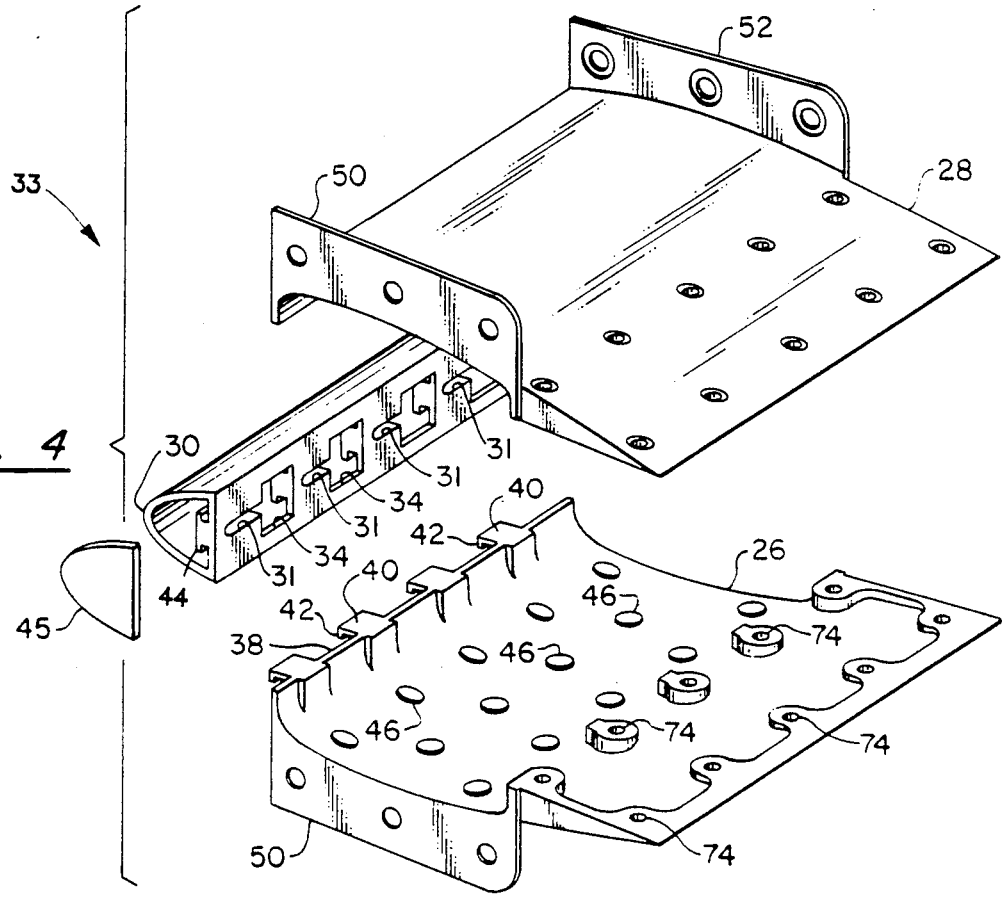
FIG. 4 is an exploded view in perspective showing the strut fairing.
Figure 2:
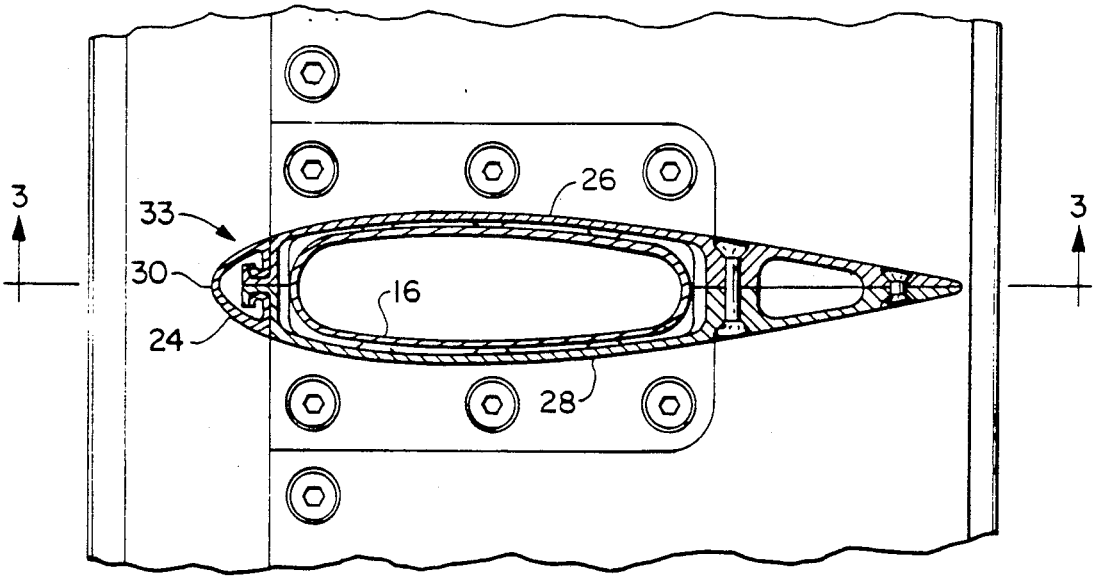
FIG. 2 is a partial view partly in section and partly in elevation taken along line 2—2 of FIG. 1.
Figure 3:
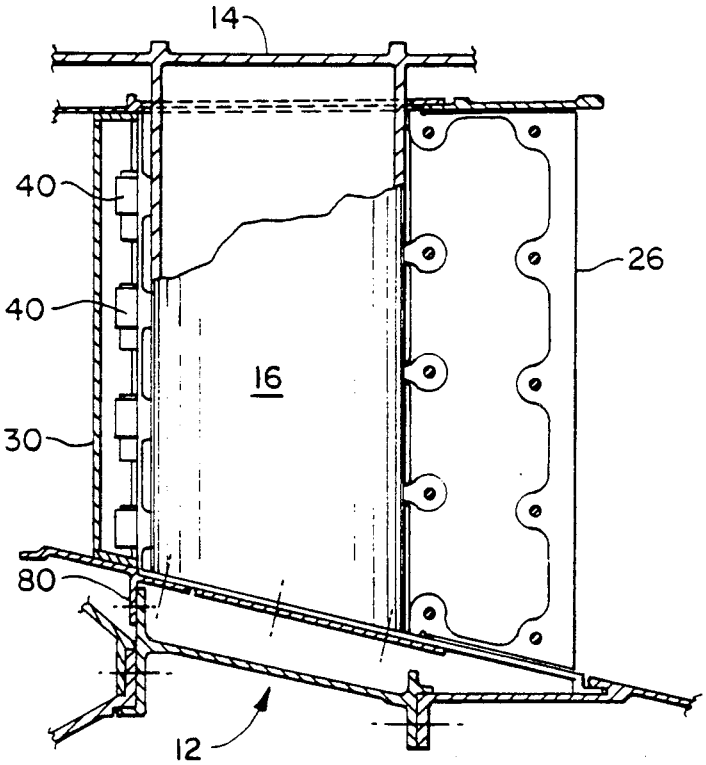
FIG. 3 is a sectional view taken along line 3—3 of FIG. 2.
Figure 5:
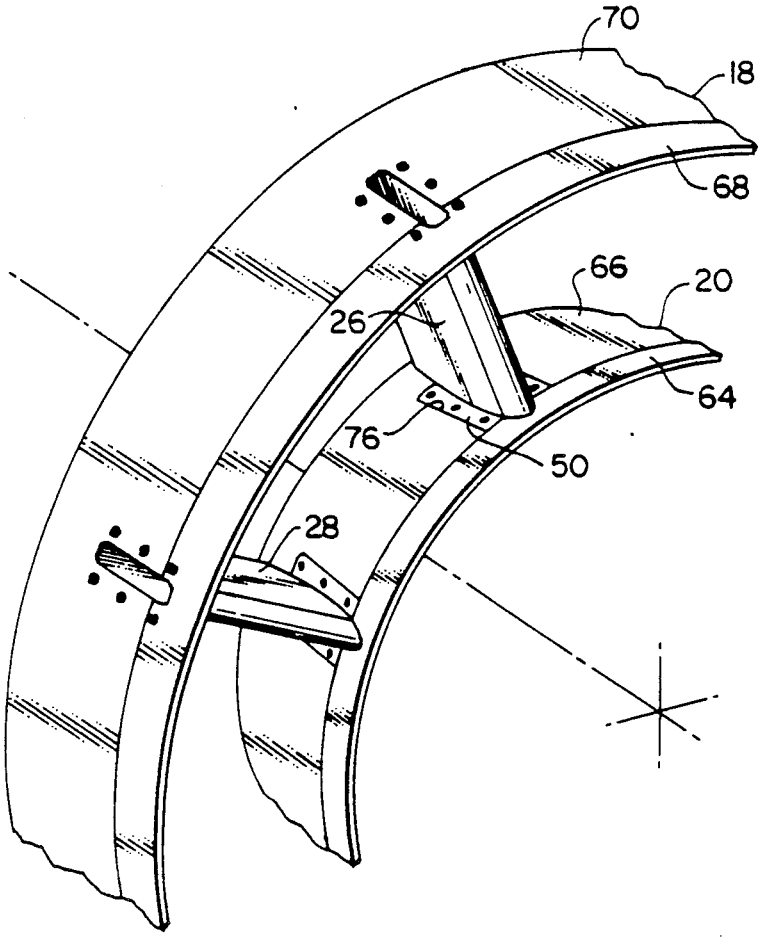
FIG. 5 is a partial view in perspective showing the assembled fairing for the turbine exhaust case.

As can best be seen in FIGS. 2 and 4, the strut fairing generally illustrated by reference numeral 33 consists of three pieces, the nose 24 and the two symmetrical halves 26 and 28 extending axially relative to the flow of the gas path. Obviously, the fairing is contoured to define an efficient aerodynamic surface so as not to penalize the engine's working medium.

In this construction, the nose piece is hollow and generally hyperbolic shaped in cross section with the apex at the leading edge 30 so as to first see the gas path. The remote end is planar and carries a plurality of slots 31 extending from adjacent sides. A plurality of larger slots 34 are spaced between the side edge and are dimensioned to complement the projections 40 found on the fore ends 38 of the half pieces 28 and 26. The projections 40 serve to secure the nose piece in the assembled position by inserting them into slots 34 and sliding the nose so that the projections 40 are out of register with slots 34 and in register with slots 31. The depending lip 42 fits behind the ledge or shoulder 44 formed on the internal slot 31 and serves to hold the nose strut to the pair of half members 28 and 26. An end cap 45 is dimensioned to fit at the ends of nose 24 to seal the internal portion of the nose from the gas path.

A plurality of risers or dimples 46 are formed on the internal walls of half members 26 and 28 to assure that there is an air space between these members and the struts being encapsulated.

Each half member 26 and 28 carry depending flanges 50 and 52 which serve to attach the assembled unit to the inner and outer ring like members 20 and 18, respectively. The inner diameter fairing 20 and the outer diameter fairing 18 are each constructed in two annular members 64, 66 and 68, 70, respectively, and are secured in place to the strut fairings 33 by a plurality of internal drive cap screws. Once the two fairing halves 26 and 28 are assembled and riveted through the rivet holes 74 and the nose piece is fastened in place, the fore inner diameter fairing 64 is secured in place and underlies the nose 24 so as to prevent it from falling out.

As can be appreciated from the foregoing, the fairing 33 is free floating, that is it is allowed to expand radially independent of the strut 16. A suitable spline type connection 80 (not shown) between flanges of the fairing 64 and inner ring 12 permit radial movement and restrain axial movement.

It is apparent from the foregoing that disassembly will be the reverse of the assembly procedure described above.

To assure a clean aerodynamic surface, flanges 50 and 52 are dimensioned to fit into the complementary recesses 76 formed in the inner and outer fairing 20 and 18.

Although this invention has been shown and described with respect to detailed embodiments thereof, it will be understood by those skilled in the art that various changes in form and detail thereof may be made without departing from the spirit and scope of the claimed invention.

We claim:

1. For a gas turbine engine having a turbine exhaust case comprising a pair of concentrically spaced rings and a plurality of radially extending struts interconnecting and supporting said rings, fairing means encapsulating at least one of said struts including a nose extending radially and coextensive with said strut and a pair of complementary axially extending halves in allochiral relationship coextensive with said strut defining with said nose an aerodynamically shaped body and connection means for removably connecting said nose to said halves at their most forward end, said nose is hyperbolic shape in cross section defining a leading edge and a relatively flat face remote from said leading edge, a plurality of narrow slots extending into wider slows radially spaced in said flat face, axially extending protrusions having a wider depending member on the forward face of said halves complementing said wider slots so that positioning said nose radially places said wider depending member out of register with said larger slots and said projection in register with said narrow slots whereby said nose is removable by returning said wider depending member in register with said wider slots.

2. For a gas turbine engine as claimed in claim 1 including an outer ring fairing having a pair of complementary ring elements in axial relationship having slots fitting around one end of said strut slidingly mounted relative to the outer of said concentrically mounted rings.

3. For a gas turbine engine as claimed in claim 2 including an inner ring fairing having a pair of complementary ring elements in axial relationship mounted in sliding relationship relative to the inner of said pair of concentrically mounted rings.

4. For a gas turbine engine as claimed in claim 3 wherein said halves each have a flange at one end and a recess formed in said inner ring to receive said flange and define therewith an aerodynamically clean surface between said flange and said inner fairing.

5. For a gas turbine engine as claimed in claim 4 wherein one of said pair of ring elements in said inner ring fairing underlies an edge of said nose to prevent said nose to move radially with respect to said inner ring fairing and said outer ring fairing.

6. For a gas turbine engine as claimed in claim 5 including a plurality of axial and radial spaced dimples extending inwardly toward said strut defining therewith space between said halves and said strut.

7. For a gas turbine engine having a gas path of engine working medium, a turbine exhaust case disposed in said gas path, said exhaust case having an outer ring and an inner ring mounted in concentric relationship, a plurality of circumferentially spaced hollow struts extending between said inner ring and said outer ring, said hollow struts being adapted to pass lubrication lines and support rods therethrough, the improvement comprising fairing means encapsulating said struts, said fairing means includes a nose coextensive with the forward end of said struts, a first side half member extending from said nose to the aft end of said strut, and a complementary second side half member extending from said nose and being in allochiral relationship with said first half member, said fairing means defining an aerodynamically shaped body for defining between adjacent struts passageways for said gas path and means for connecting said first half member to said second half member and said nose to said first half member and said second half member, said fairing means being mounted in sliding relationship with said struts, and defining a heat shield from the heat in said gas path for preventing lubricant in said lubrication lines from coking and preventing said support rods from losing tension imparted thereto at assembly.

8. For a gas turbine engine as claimed in claim 7 wherein the improvement further includes a removable nose having a generally elongated shaped hollow body configured in a hyperbolic shape in cross section having a leading edge at the apex, a flat surface remote from the leading edge and having a plurality of slots spaced from edge to edge, said first half member and said second half member having forward extending projections with a depending member extending from the forward end of said projection and complementing said slots so that said depending member fits into a wider portion of said slot and said projection fits into a narrower portion of said slots, said nose being in sliding relation with said projection whereby said wider slot is placed out of register with said wider slots and said depending member fits into the hollow portion of said nose.

9. For a gas turbine engine as claimed in claim 8 wherein the improvements includes end caps mounted at the edges of said nose to seal the hollow portion from said gas path.

10. For a gas turbine engine as claimed in claim 9 wherein said improvement includes a plurality of spaced dimples extending from the inner surfaces of said first half member and said second half member defining with said struts a space therebetween.

11. For a gas turbine engine as in claim 8 wherein the improvement includes inner and outer ring fairing means, said inner and outer ring fairing each includes a pair of rings mounted in axial relationship and having recesses surrounding a portion of said struts and being in sliding relationship therewith and with said inner and outer ring.

12. For a gas turbine as claimed in claim 1 wherein the improvement includes flanges carried on the inner edge of said first half member and said second half member fitting into a recess formed in said inner ring fairing and defining a clean aerodynamic surface for said gas path.

13. For a gas turbine engine as claimed in claim 12 wherein the pair of axially mounted inner rings being in a forward and rearward relationship relative to the flow in said gas path, said forward ring underlying one edge of said nose securing said nose in the operable position whereby removal of said forward ring permits removal of said nose.

* * * * *

UNITED STATES PATENT AND TRADEMARK OFFICE

CERTIFICATE OF CORRECTION

PATENT NO. : 4,993,918

DATED : February 19, 1991

INVENTOR(S) : Richard S. Myers et al

It is certified that error appears in the above-identified patent and that said Letters Patent is hereby corrected as shown below:

In column 1, after the title, insert "This invention was made under a Government contract and the Government has rights herein."

Col. 4, line 35, (claim 1), change "slows " to --slots--

Col. 6, line 23, (claim 12), change "claim 1" to --claim 11--

Signed and Sealed this

Twenty-sixth Day of January, 1993

*Attest:*

STEPHEN G. KUNIN

*Attesting Officer*

*Acting Commissioner of Patents and Trademarks*